United States Patent [19]

Ghosh et al.

[11] Patent Number: 4,798,300

[45] Date of Patent: Jan. 17, 1989

[54] BOTTLE WITH INTEGRAL CAP-REMOVING RECESS

[75] Inventors: Asim Ghosh, Willowdale; Aram H. Toukmanian, Toronto, both of Canada

[73] Assignee: Carling O'Keefe Breweries of Canada Limited, North York, Canada

[21] Appl. No.: 162,964

[22] Filed: Mar. 2, 1988

[30] Foreign Application Priority Data

Mar. 3, 1987 [CA] Canada ..... 531005

[51] Int. Cl.[4] ..... B65D 23/00; B65D 41/12

[52] U.S. Cl. ..... 215/10; 215/295; 215/302; 215/328; 215/100 R; 81/3.09; 81/3.15; 206/508

[58] Field of Search ..... 215/10, 100 R, 328, 215/228, 295, 302; 81/3.09, 3.15, 3.4, 3.07; 220/85 D; 206/508, 509

[56] References Cited

U.S. PATENT DOCUMENTS

| | | | |
|---|---|---|---|
| D. 161,569 | 1/1951 | Bushman | 81/3.4 X |
| D. 261,854 | 11/1981 | Nielsen | 81/3.4 X |
| 1,952,660 | 3/1934 | Dryden | 81/3.4 |
| 2,724,849 | 11/1955 | Schultz | 81/3.09 |
| 4,337,678 | 7/1982 | Mumford | 81/3.4 |

FOREIGN PATENT DOCUMENTS

| | | | |
|---|---|---|---|
| 1524899 | 5/1968 | France | 215/10 |
| 1551924 | 1/1969 | France | 215/10 |
| 2186868 | 8/1987 | United Kingdom | 81/3.4 |

*Primary Examiner*—Sue A. Weaver
*Attorney, Agent, or Firm*—Sim & McBurney

[57] ABSTRACT

A bottle includes a mouth and a neck adjoining the mouth. The neck has helical ribs on the outside to permit application of a peripherally indented, screw-on crown. The main body of the bottle has a base, which is provided with an upward recess. A plurality of inwardly projecting ribs is provided around the periphery of the recess, each rib being convexly rounded and devoid of points, and having two concavely rounded shoulder portions on either side, so that stress concentration is minimized. The recess is sized to receive a peripherally indented crown of the same size as that receivable on the neck, so that the ribs register in at least some of the peripheral indentations. Thus, one bottle can serve as a crown remover for another, without a significant risk that the ribs will break or crack.

13 Claims, 2 Drawing Sheets

BOTTLE WITH INTEGRAL CAP-REMOVING RECESS

This invention relates generally to bottles for beverages, wherein the bottle employs a twist-off cap or This invention has particular application to the industry, but is not limited thereto.

BACKGROUND OF THIS INVENTION

It has recently become common for breweries to sell beer in bottles that are sealed with twist-off crown. This is distinguished from the pry-off crown that was utilized virtually exclusively for many years. Because the twist-off crowns are applied by machinery, it sometimes happens that the torque necessary to "break" the crown loose is greater than certain individuals can apply.

An attempt has been made in the prior art to provide a means by which the twist-off crowns can be more easily removed. Canadian Industrial Design Registration No. 33014 issued on Oct. 19, 1970, discloses a beer bottle having a central recess in the bottom or base of the bottle, the recess being provided with 7 inwardly projecting, equally spaced ribs of a pointed, triangular shape, these being adapted to enter into peripheral indentations in the crown of another bottle, whereby one bottle may be used to remove the crown from another, by the principle of mechanical advantage.

The earlier Canadian Industrial Design Registration, however, suffers from an important drawback. As illustrated in the registered design, the ribs are extremely pointed, having a true triangular cross section with an acute angle at the apex, which makes them very susceptible to stress concentration when the bottle of which they are a part is used to remove the crown from another bottle. It appears that the designer of the bottle which is the subject of the industrial design registration had in mind the idea of causing the pointed ribs to bite into the crown of another bottle, in order to obtain a secure grip on the crown and avoid slipping.

It has been discovered however, that such an acutely pointed configuration is particularly susceptible to cracking due to stress-concentration at the sharp-angled bends (both at the apex and at the shoulder regions), thereby rendering useless the crown openability feature of a returnable bottle. As is appreciated in addition such broken off pieces of glass may present a health hazard.

GENERAL DESCRIPTION OF THIS INVENTION

Accordingly, this invention provides a bottle which includes a neck adjoining the mouth. The neck has helical rib means on the outside adjacent the mouth to permit application of a peripherally indented, screw-on crown. The bottle further has a main body portion with a base, and an upward recess is provided centrally in the base. The recess is substantially circular when seen in bottom plan, and has a plurality of inwardly projecting, substantially identical ribs around the periphery thereof. Each rib is convexly rounded and devoid of points, and has two concavely rounded shoulder portions on either side, thereby to minimize stress concentration. The recess is sized to receive a peripherally indented crown of the same size as that receivable on the neck, such that the ribs register in at least some of the peripheral indentations, whereby one bottle can serve as a crown remover for another

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
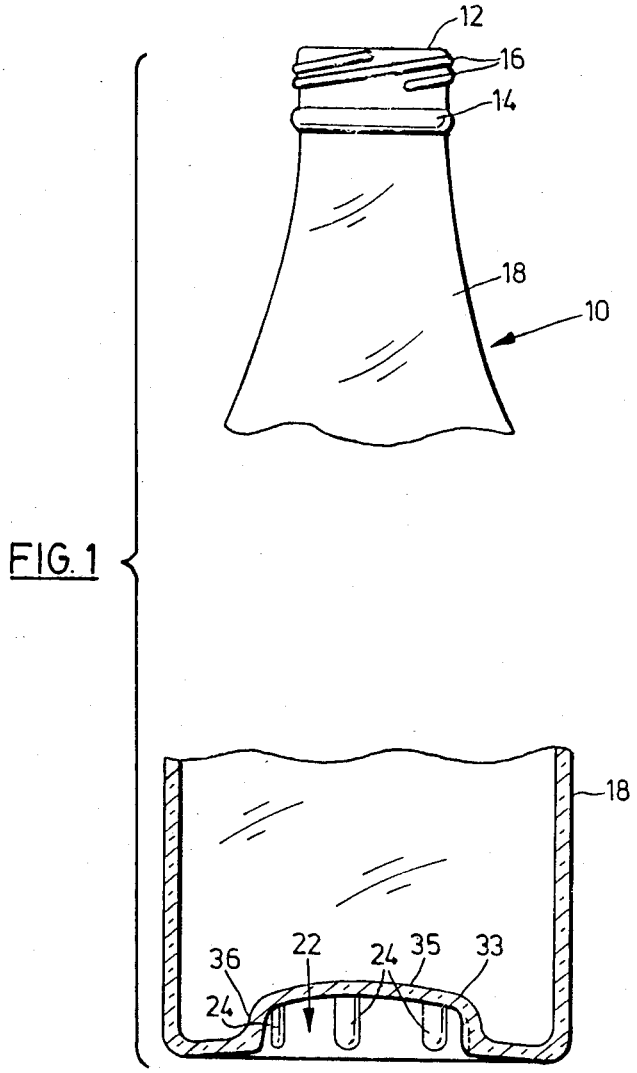
FIG. 1 is a partly broken away view of a bottle, showing the neck of the bottle in elevation at the top, and the base portion of the bottle in axial section at the bottom of the figure.

Attention is first directed to FIG. 1, which shows a bottle 10 having a mouth 12, and a neck 14 adjoining the mouth 12. The neck 14 has helical rib means 16 on the outside adjacent the mouth 12 to permit application of a peripherally indented, screw-on crown of a conventional nature (not illustrated).

Figure 2:
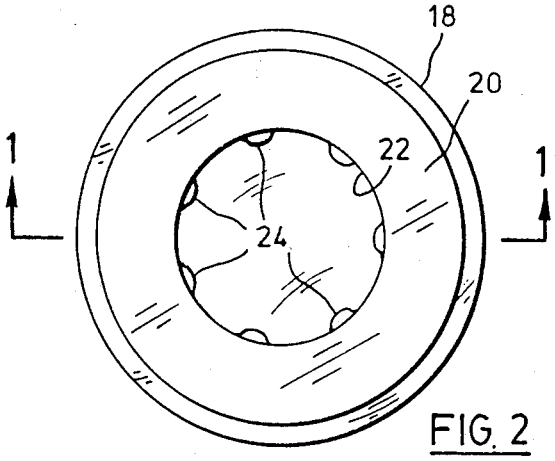
FIG. 2 is a bottom plan view of the bottle of FIG. 1, showing the section line 1—1 along which the lower portion of FIG. 1 is taken.

The bottle 10 has a main body portion 18 with a base 20 having an upward recess 22 centrally thereof. The recess 22 is substantially circular when seen in bottom plan, as in FIG. 2. The recess includes a plurality of inwardly projecting, substantially identical ribs 24 substantially equally spaced around the periphery of the recess 22. Each rib 24 is convexly rounded and devoid of points, and has two concavely rounded shoulder portions on either side, thereby to minimize stress concentration.

Figure 3:
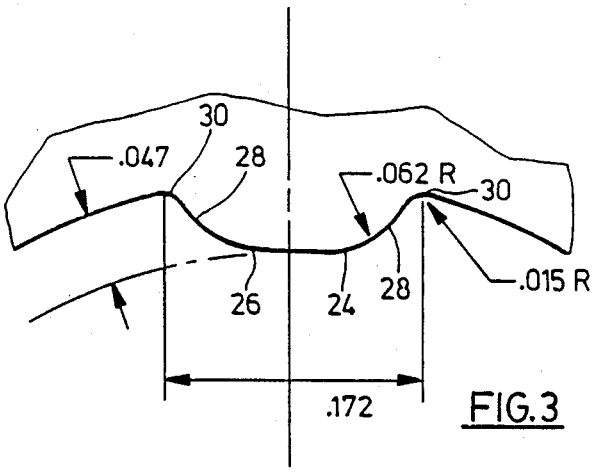
FIG. 3 is a bottom plan view, to a larger scale, of one of the ribs seen in FIG. 2.

Attention is directed to FIG. 3, which shows one of the ribs 24 in profile or outline. It can be seen that the rib has, in cross-section, a central relatively flat portion 26 which merges at either side into two lateral relatively curved portions 28, and that each curved portion 28 merges into one of the concavely rounded shoulder portions, identified by the numeral 30 in FIG. 3. Due to this construction, the lateral width of each rib is greater than its height, the height being measured radially of the bottle. By way of a non-limiting example, the lateral width of the rib 24 in FIG. 3 is marked as 0.172 inches, whereas the height of the rib measured radially of the bottle is marked as 0.047 inches. In a preferred version of the invention, the number obtained by dividing the lateral width of a rib by its height lies between about 3.2 and about 4.2, and is preferably around 3.7.

It will be understood that the recess 22 is sized to receive a peripherally indented crown of the same size as that receivable on the neck 14, such that the ribs 24 register in at least some of the peripheral indentations, whereby one bottle can serve as a crown remover for another. Conventionally, the crowns have 21 peripheral indentations, hence the selection of 7 ribs. It will be understood, however, that more or less ribs could be provided, so long as the position of the ribs was such as to allow them to register simultaneously in an equal number of the peripheral indentations in a crown. It will further be understood that the ribs do not need to be equally spaced, although equal spacing is convenient from a molding point of view.

Referring again to FIG. 3, in a preferred embodiment the width of each rib will lie between about 0.16 inch and about 0.18 inch, and the width marked in FIG. 3 is 0.172 inch. It is also indicated in FIG. 3 that the radius of curvature of the lateral, relatively curved portions 28 is about 0.062 inches. It is considered that a preferred range for this radius of curvature is between about 0.05 inch and about 0.07 inch.

Also in FIG. 3, the radius of curvature of the concavely rounded shoulder portions 30 is given as 0.015 inch, and it is considered that this should preferably lie between about 0.01 inch and about 0.02 inch.

The inner surface of the base 20 of the main body of the bottle, as seen at the bottom of FIG. 1, is defined by smoothly curving surfaces This results in several advantages: (1) It minimizes areas where mold can be trapped; (2) it simplifies cleaning during repeated use of a bottle; (3) it helps optimize empty bottle inspection through standard empty bottle inspection equipment; and (4) it helps to minimize stress concentration adjacent the recess 22 when one bottle is used for removing the crown from another. More particularly, in the preferred embodiment, the inner surface 33 of the base 20 of the main body includes an upwardly convexly protruding central portion 35 adjacent the recess 22, and an upwardly concave peripheral portion 36 annularly surrounding the central portion 35 In a preferred embodiment, the radius of curvature of the peripheral portion 36 is approximately 0.094 inches.

Figure 4:
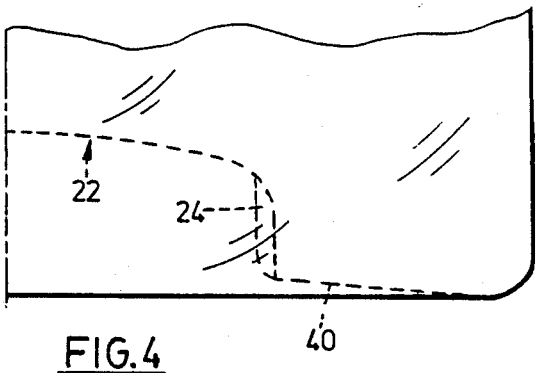
FIG. 4 is a partial view, to a larger scale than FIGS. 1 or 2, showing the elevational profile of the recess and the adjacent portion of the base of the bottle.

FIG. 4 is provided to show preferred profiles for the recess 22, the ribs 24 and the bottom surface 40 of the bottle. The various dimensions, however, are given by way of example only, and are not intended to be limiting.

It will thus be realized that there has been provided a bottle construction having an improved recess construction on the bottom, by which the crown of another bottle can be twisted off by exertion of minimum torque. The improvement lies essentially in minimizing the likelihood of breakage or cracking of the ribs which cooperate with peripheral indentations of a crown to allow one bottle to remove the crown from another bottle. Hence this system for crown removal is better suited for use on returnable bottles and, as previously noted, reduces health hazard risks.

While one embodiment of this invention has been illustrated in the accompanying drawings, and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A bottle, comprising:

a mouth, a neck adjoining the mouth, the neck having helical rib means on the outside adjacent the mouth to permit application of a peripherally indented, screw-on crown, a main body portion having a base, an upward recess centrally in the base, the recess being substantially circular when seen in bottom plan, and a plurality of inwardly projecting, substantially identical ribs around the periphery of the recess, each rib being convexly rounded and devoid of points, and having two concavely rounded shoulder portions on either side, whereby to minimize stress concentration, the recess being sized to receive a peripherally indented crown of the same size as that receivable on the neck, such that the ribs register in at least some of the peripheral indentations, whereby one bottle can serve as a crown remover for another.

2. The invention claimed in claim 1, in which the convexity of each rib comprises, in cross-section, a central, relatively flat portion merging into two lateral, relatively curved portions, each curved portion merging into one of the said concavely rounded shoulder portions, and in which the lateral width of each rib is greater than its height measured radially of the bottle.

3. The invention claimed in claim 2, in which division of the lateral width of each rib by its height yields a number between about 3.2 and about 4.2.

4. The invention claimed in claim 3, in which the lateral width of each rib lies between about 0.16 inch and about 0.18 inch, and in which the radius of curvature of the lateral, relatively curved portions lies between abut 0.05 inch and about 0.07 inch.

5. The invention claimed in claim 4, in which the radius of curvature of the concavely rounded shoulder portions lies between about 0.01 inch and about 0.02 inch.

6. The invention claimed in claim 1, in which there are 7 ribs equally spaced around the recess periphery.

7. The invention claimed in claim 1, in which the inner surface of the base of the main body is defined by smoothly curving surfaces, in order to minimize stress concentration adjacent the recess when one bottle is used for removing the crown from another.

8. The invention claimed in claim 7, in which said inner surface includes an upwardly convexly protruding central portion adjacent the recess, and an upwardly concave peripheral portion annularly surrounding the central portion.

9. The invention claimed in claim 8, in which the radius of curvature of said peripheral portion is approximately 0.094 inches.

10. The invention claimed in claim 8, in which there are 7 ribs equally spaced around the recess periphery.

11. The invention claimed in claim 10, in which the inner surface of the base of the main body is defined by smoothly curving surfaces, in order to minimize stress concentration adjacent the recess when one bottle is used for removing the crown from another.

12. The invention claimed in claim 11, in which said inner surface includes an upwardly convexly protruding central portion adjacent the recess, and an upwardly concave peripheral portion annularly surrounding the central portion.

13. The invention claimed in claim 12, in which the radius of curvature of said peripheral portion is approximately 0.094 inches.

* * * * *